US005947309A

United States Patent [19]

Anderson

[11] Patent Number: 5,947,309

[45] Date of Patent: Sep. 7, 1999

[54] CONTAINER-CLOSURE COMBINATION WITH IMPROVED SEALING FEATURE

[75] Inventor: Robert S. Anderson, Scottsdale, Ariz.

[73] Assignee: Premium Plastics, Inc., Chicago, Ill.

[21] Appl. No.: 09/036,879

[22] Filed: Mar. 9, 1998

[51] Int. Cl.[6] ..... B65D 41/04

[52] U.S. Cl. ..... 215/44; 215/45; 215/346

[58] Field of Search ..... 215/44, 45, 341, 215/346

[56] References Cited

U.S. PATENT DOCUMENTS

| | | | |
|---|---|---|---|
| 2,993,612 | 7/1961 | Trautvetter . | |
| 3,069,040 | 12/1962 | Corsette . | |
| 3,223,269 | 12/1965 | Williams . | |
| 3,517,848 | 6/1970 | Kesler et al. . | |
| 3,592,349 | 7/1971 | Baugh . | |
| 3,695,475 | 10/1972 | Ruekberg . | |
| 3,784,038 | 1/1974 | Uhlig | 215/45 X |
| 3,794,200 | 2/1974 | Marks | 215/318 X |
| 3,888,378 | 6/1975 | Gerk . | |
| 3,923,181 | 12/1975 | Libit . | |
| 4,057,160 | 11/1977 | Victor et al. . | |
| 4,190,171 | 2/1980 | Kulle et al. . | |
| 4,298,129 | 11/1981 | Stull . | |
| 4,354,609 | 10/1982 | Hidding . | |
| 4,444,326 | 4/1984 | Musel . | |
| 4,448,319 | 5/1984 | Kern . | |
| 4,489,845 | 12/1984 | Aichinger et al. . | |
| 4,579,239 | 4/1986 | Hart . | |
| 4,643,330 | 2/1987 | Kennedy . | |
| 4,712,699 | 12/1987 | Lutz . | |
| 5,190,178 | 3/1993 | Luch . | |
| 5,297,688 | 3/1994 | Beck et al. . | |
| 5,456,376 | 10/1995 | Luch et al. . | |
| 5,462,875 | 10/1995 | Barr et al. . | |
| 5,489,036 | 2/1996 | Arkins | 215/343 |
| 5,527,513 | 6/1996 | Burns . | |
| 5,549,213 | 8/1996 | Robbins, III et al. . | |
| 5,553,727 | 9/1996 | Molinaro | 215/44 |
| 5,613,616 | 3/1997 | Monus . | |

FOREIGN PATENT DOCUMENTS

| | | |
|---|---|---|
| 1.088.929 | 3/1955 | France . |
| 725860 | 3/1955 | United Kingdom . |
| 948.908 | 2/1964 | United Kingdom . |

*Primary Examiner*—Stephen K. Cronin

[57] ABSTRACT

A container made from a rigid, polymeric material, or from glass or metal, has a frusto-conical or cylindrical wall defining an outer thread and having an upper edge, which defines a sealing bead extending circumferentially and having a cross-section conforming to a circular arc of more than 180°. A closure made from a comparatively resilient, polymeric material has a circumferential recess adapted to receive the sealing bead with a snap fit so as to prove a liquid-tight seal. The closure has a frusto-conical or cylindrical skirt defining an inner thread. A reinforcing bead at a lower edge of the closure skirt clears the outer thread when the closure is snap-fitted or screwed onto the container and provides the closure skirt with sufficient hoop strength to prevent the inner thread from snapping upwardly past the outer thread upon relative rotation of the closure and the container to unscrew the closure from the container.

10 Claims, 1 Drawing Sheet

FIG. 1
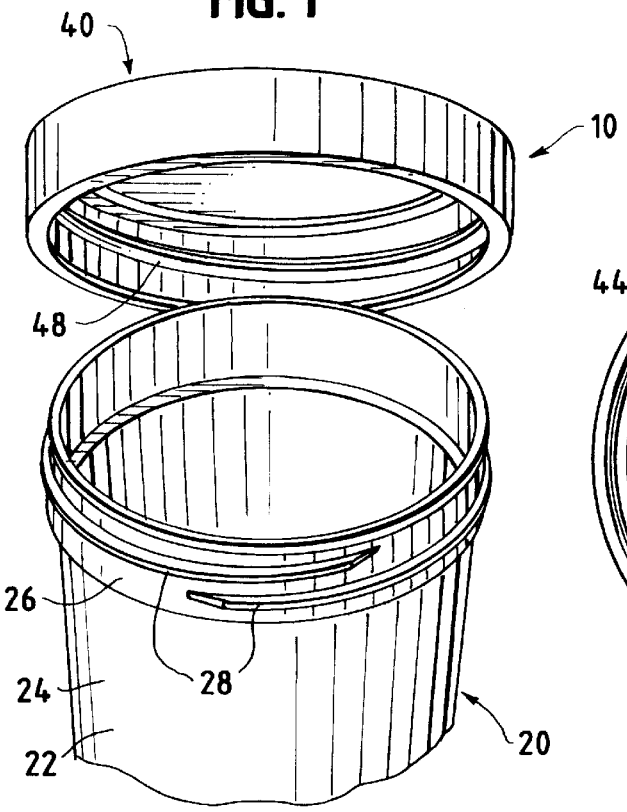
FIG. 2
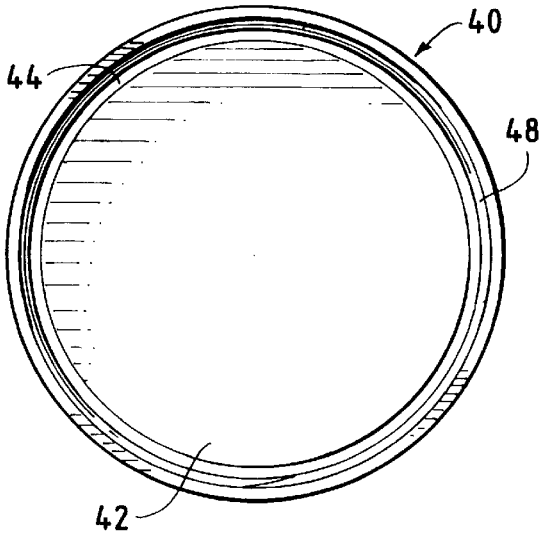
FIG. 4
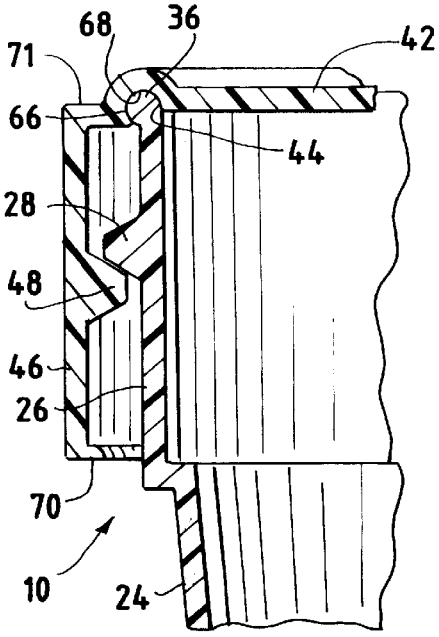
FIG. 3
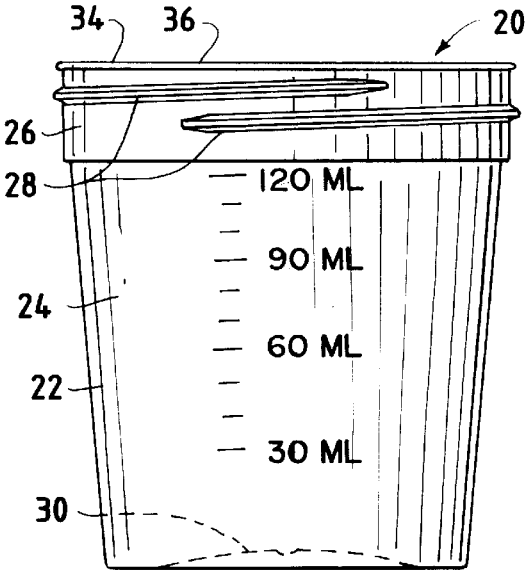
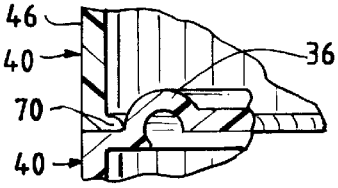
FIG. 5

CONTAINER-CLOSURE COMBINATION WITH IMPROVED SEALING FEATURE

TECHNICAL FIELD OF THE INVENTION

This invention improves a container-closure combination of a type comprising a container made from glass, metal, or a comparatively rigid, polymeric material with a frusto-conical or cylindrical wall defining an outer thread and a closure made from a comparatively resilient, polymeric material with a frusto-conical or cylindrical wall defining an outer thread, whereby the closure is adapted to be screwed onto the container and whereby the closure is adapted to be unscrewed from the container.

BACKGROUND OF THE INVENTION

Many examples of container-closure combinations of the type noted above are known from prior patents. Those patents include Still U.S. Pat. No. 4,298,129, Aichinger et al. U.S. Pat. No. 4,489,845, Lutz U.S. Pat. No. 4,712,699, Beck et al. U.S. Pat. No. 5,297,688, and Luch et al. U.S. Pat. No. 5,456,376.

For handling of bodily fluids, such as urine specimens, which could present biohazards, it is important that the container-closure combination provides a liquid-tight seal when the closure is screwed onto the container. This invention has resulted from efforts to improve the liquid-tight seal provided by a container-closure combination of the type noted above.

SUMMARY OF THE INVENTION

This invention provides improvements in a container-closure combination of the type noted above. The container-closure combination comprises a container and a closure adapted to fit onto the container. As explained below, this invention provides an improved seal between the closure and the container, whereby the container-closure combination can be effectively used for handling of bodily fluids, such as urine. Its utility is not limited, however, to handling of bodily fluids.

The container, which defines an axis, has a wall, which defines an outer thread. An upper edge of the container wall defines an upper mouth of the container and defines a sealing bead extending circumferentially around the upper edge.

The closure has a closed top, which has a circumferential recess adapted to receive the sealing bead with a snap fit and to provide a liquid-tight seal where the sealing bead is snapped into the circumferential recess. The closure has a skirt adjoining the closed top at an upper edge of the closure skirt. The closure skirt defines an inner thread.

The outer and inner threads are adapted to coact to enable the closure to be screwed onto the container until the sealing bead is received by the circumferential recess, upon relative rotation of the closure and the container in one rotational sense. The outer and inner threads are adapted to coact to enable the closure to be unscrewed from the container and to enable the sealing bead to be removed from the circumferential recess, upon relative rotation of the closure and the container in an opposite sense.

Preferably, the closure skirt defines a reinforcing bead at a lower edge of the closure skirt. The reinforcing bead clears the outer thread when the closure is screwed onto the container. The reinforcing bead provides the closure skirt with sufficient hoop strength to prevent the inner thread from snapping upwardly past the outer thread, upon relative rotation of the closure and the container to unscrew the closure from the container, until the sealing bead is snapped from the circumferential recess. Preferably, the sealing bead has an outer surface and the circumferential recess has an inner surface, and each of the outer and inner surfaces has a cross-section conforming to a circular arc of more than 180°.

Preferably, the container is made from a comparatively rigid material, such as glass, metal, or a comparatively rigid, polymeric material, whereas the closure is made from a comparatively resilient material. Desirably, the container material is a transparent or translucent material, so that its contents are observable through the container wall.

These and other objects, features, and advantages of this invention are evident from the following description of a preferred embodiment of this invention, with reference to the accompanying drawings.

BRIEF DESCRIPTION OF THE DRAWINGS

FIG. 1 is a fragmentary, perspective view of a container-closure combination constituting a preferred embodiment of this invention, the closure being shown as lifted partially from the container to show interior details of the closure.

FIG. 2 is a bottom view of the closure, apart from the container.

FIG. 3 is an elevational view of the container, apart from the closure.

FIG. 4 is a fragmentary, sectional view showing the closure fitted onto the container.

FIG. 5 a fragmentary detail showing, in cross-section, two similar closures in a stack.

DETAILED DESCRIPTION OF THE PREFERRED EMBODIMENT

As shown in FIGS. 1 and 4, a container-closure combination 10 constituting a preferred embodiment of this invention comprises a container 20 and a closure 40, which is adapted to be snap-fitted onto the container 20 or to be screwed onto the container 20. An improved seal is provided between the closure 40 and the container 20. Thus, the container-closure combination 10 can be effectively used for handling of bodily fluids, such as urine.

The container 20, which defines an axis, has a side wall 22, which has a lower, frusto-conical portion 24 and an upper, cylindrical portion 26 defining an outer thread 28, which is continuous, and a bottom wall 30, which is closed and which is unitary with the side wall 22. An upper edge 34 of the wall 22 defines an upper mouth of the container 20 and defines a sealing bead 36 extending circumferentially around the upper edge 34.

Preferably, the container 20 is molded from a comparatively rigid, polymeric material, such as polycarbonate, which is transparent so as to enable the contents of the container 20 to be readily seen through the side wall 22. Alternatively, the container 20 is made from clear or opaque glass or from metal, such as aluminum. Preferably, shown in FIG. 3, the side wall 22 has graduated markings. Preferably, the closure 40 is molded from a comparatively resilient, polymeric material, such as polyvinyl chloride, which is preferred.

The closure 40, which also defines an axis, has a closed top 42, which defines a circumferential recess 44 adapted to receive the sealing bead 36 with a snap fit and to provide the improved seal 60, which is liquid-tight, where the sealing bead 36 is snapped into the circumferential recess 44. The closure 40 has a cylindrical skirt 46 adjoining the closed top 42 at an upper edge of the skirt 46. The skirt 46 defines an inner thread 48, which is continuous.

The outer thread 28 and the inner thread 48 are adapted to coact so as to enable the closure 40 to be screwed onto the container 20 until the sealing bead 36 is snapped into the circumferential recess 44, upon relative rotation of the closure 40 and the container 20 in one rotational sense, which is clockwise when looking downwardly at the closure top 42. The outer thread 28 and the inner thread 48 are adapted to coact to enable the closure 40 to be unscrewed from the container 20 and to enable the sealing bead 36 to be snapped from the circumferential recess 44, upon relative rotation of the closure 40 and the container 20 in an opposite sense, which is counter-clockwise when looking downwardly at the closure top 42.

As shown, the sealing bead 36 has an outer surface 66 with a cross-section conforming to a circular arc of more than 180° and the circumferential recess 44 has an inner surface 68 with a cross-section conforming to a similar arc, whereby the sealing bead 36 must be snapped into and from the circumferential recess 44.

The skirt 46 defines a reinforcing bead 70, which is annular and which projects inwardly, toward the axis defined by the closure 40, at a lower edge 72 of the skirt 46. The reinforcing bead 70 is configured so as to clear (not interfere with) the outer thread 28 when the closure 40 is screwed onto the container 20. The reinforcing bead 70 provides the skirt 46 with sufficient hoop strength to prevent the inner thread 48 from snapping upwardly past the outer thread 28, upon relative rotation of the closure 40 and the container 20 to unscrew the closure 40 from the container 20, until the sealing bead 36 is snapped from the circumferential recess 44.

As shown in FIG. 5, the closed top 42 of the closure 40 has an annular ridge projecting upwardly where the cylindrical recess 44 is defined. The reinforcing bead 70 is sized so as to be slightly larger than the annular ridge, whereby the closure 40 can be neatly stacked with similar closures 40 in a vertically nested, generally stable stack.

Various modifications are possible in the preferred embodiment without departing from the scope and spirit of this invention.

I claim:

1. A container-closure combination comprising a container and a closure adapted to fit onto the container;

the container defining an axis and having a wall, the container wall defining an outer thread and having an upper edge, the upper edge defining an upper mouth of the container and defining a sealing bead extending circumferentially around the upper edge;

the closure having a closed top having a circumferential recess adapted to receive the sealing bead with a snap fit and to provide a liquid-tight seal where the sealing bead is snapped into the circumferential recess, the closure having a skirt adjoining the closed top at an upper edge of the closure skirt, the closure skirt defining an inner thread, the outer and inner threads being adapted to coact to enable the closure to be screwed onto the container until the sealing bead is snapped into the circumferential recess, upon relative rotation of the closure and the container in one rotational sense, the outer and inner threads being adapted to coact to enable the closure to be unscrewed from the container and to enable the sealing bead to be snapped from the circumferential recess, upon relative rotation of the closure and the container in an opposite sense;

wherein the sealing bead has an outer surface and the circumferential recess has an inner surface and wherein each of the outer and inner surfaces has a cross-section conforming to a circular arc of more than 180°.

2. The container-closure combination of claim 1 wherein the closure is configured so as to permit the closure to be neatly stacked with similar closures.

3. The container-closure combination of claim 1 or 2 wherein the container is made from a comparatively rigid material, whereas the closure is made from a comparatively resilient material.

4. The container-closure combination of claim 3 wherein the container is made from glass.

5. The container-closure combination of claim 3 wherein the container is made from metal.

6. The container-closure combination of claim 3 wherein the container is made from a comparatively rigid, polymeric material.

7. The container-closure combination of claim 6 wherein the comparatively rigid, polymeric material is a transparent or translucent material.

8. The container-closure combination of claim 1 or 2 wherein the closure skirt defines a reinforcing bead at a lower edge of the closure skirt, the reinforcing bead clearing the outer thread when the closure is screwed onto the container, the reinforcing bead providing the closure skirt with sufficient hoop strength to prevent the inner thread from snapping upwardly past the outer thread, upon relative rotation of the closure and the container to unscrew the closure from the container, until the sealing bead is snapped from the circumferential recess.

9. The container-closure of claim 8 wherein the closure is configured so as to permit the closure to be neatly stacked with similar closures.

10. The container-closure of claim 1 or 2 wherein the container-wall has a cylindrical portion defining the outer thread and having the upper edge and wherein the closure skirt is cylindrical.

* * * * *